United States Patent [19]

Wolfe

[11] 4,345,702

[45] Aug. 24, 1982

[54] FIBER DISSEMINATOR

[75] Inventor: Neil M. Wolfe, Cecil City, Md.

[73] Assignee: The United States of America as represented by the Secretary of the Army, Washington, D.C.

[21] Appl. No.: 181,141

[22] Filed: Aug. 25, 1980

[51] Int. Cl.[3] ..... B65D 88/72

[52] U.S. Cl. ..... 222/630; 222/405; 406/137

[58] Field of Search ..... 222/630, 637, 195, 154, 222/405; 406/137

[56] References Cited

U.S. PATENT DOCUMENTS

| | | | |
|---|---|---|---|
| 1,838,648 | 12/1931 | Atwood | 222/630 |
| 2,269,761 | 1/1942 | Gauvreau | 222/154 |
| 2,792,971 | 5/1957 | Kaiser | 222/630 |
| 2,850,214 | 9/1958 | Rooney | 406/137 |
| 3,999,750 | 12/1976 | Perkins | 222/195 |

FOREIGN PATENT DOCUMENTS

| | | | |
|---|---|---|---|
| 1357983 | 3/1964 | France | 222/630 |
| 635295 | 4/1950 | United Kingdom | 406/137 |
| 876162 | 8/1961 | United Kingdom | 222/630 |

*Primary Examiner*—H. Grant Skaggs

*Attorney, Agent, or Firm*—Nathan Edelberg; Robert P. Gibson; Max Yarmovsky

[57] ABSTRACT

There is disclosed a fiber disseminator conduit comprised of a vertical column having two sources of a gas (normally air) wherein one source provides a continuous stream of a suspension gas (such as air) to effect dispersion and separation of the particles or fibers and cause the particles and fibers to rise to a test portion thereof and a second source of intermittent gas stream below the first source to raise clumps of the particles and fibers to the first source of suspension gas.

9 Claims, 2 Drawing Figures

FIBER DISSEMINATOR

GOVERNMENTAL INTEREST

The invention described herein may be manufactured, used and licensed by or for the Government for Governmental purposes without the payment to me of any royalties thereon.

FIELD OF THE INVENTION

This invetion relates to a fiber disseminator, and more particularly to an apparatus for dispensing of particles and carbon fibers in the production of suspended agglomerate.

BACKGROUND OF THE INVENTION

Prior practice of forming suspended agglomerates required the manual insertion into a venturi leading to a disseminator zone of the carbon fibers using a tweezers and resulted in many of the fibers being broken or crushed thereby normally invalidating subsequent testing procedures.

OBJECT OF THE INVENTION

It is the object of the present invention to provide a novel fiber disseminator.

Another object of the present invention is to provide a novel fiber disseminator which substantially eliminates clumping and non-uniform residue in the production of suspended agglomerates.

A further object of the present invention is to provide a novel fiber disseminator which eliminates tedious manual positioning of carbon particles.

Still another object of the present invention is to provide a novel fiber disseminator which permit dispersion of a known disposition of particles or carbon fibers of contolled length.

A still further object of the present invention is to provide a novel fiber disseminator which permits exacting test time intervals.

Yet another object of the present invention is to provide a novel fiber disseminator which permits operation with reduced personnel.

SUMMARY OF THE INVENTION

These and other objects of the present invention are achieved in a vertical column having two sources for a gas (normally air) wherein one source provides a continuous stream of gas to effect dispersion and separation of the particles or fibers and cause the particles and fibers to rise to a test portion thereof and eventual ejection of single fibers, and a second source of an intermittent gas stream below the first source to raise clumps of the particles and fibers to the first source of suspension gas. In a preferred embodiment, the first source is located in a vertical section of the vertical column.

BRIEF DESCRIPTION OF THE DRAWING

A better understanding of the present invention as well as other objects and advantages thereof will become apparent upon consideration of the detailed disclosure thereof, especially when taken with the accompanying drawings, wherein like numerals designate like parts throughout, and wherein.

DETAILED DESCRIPTION OF THE DRAWING

Figure 1:
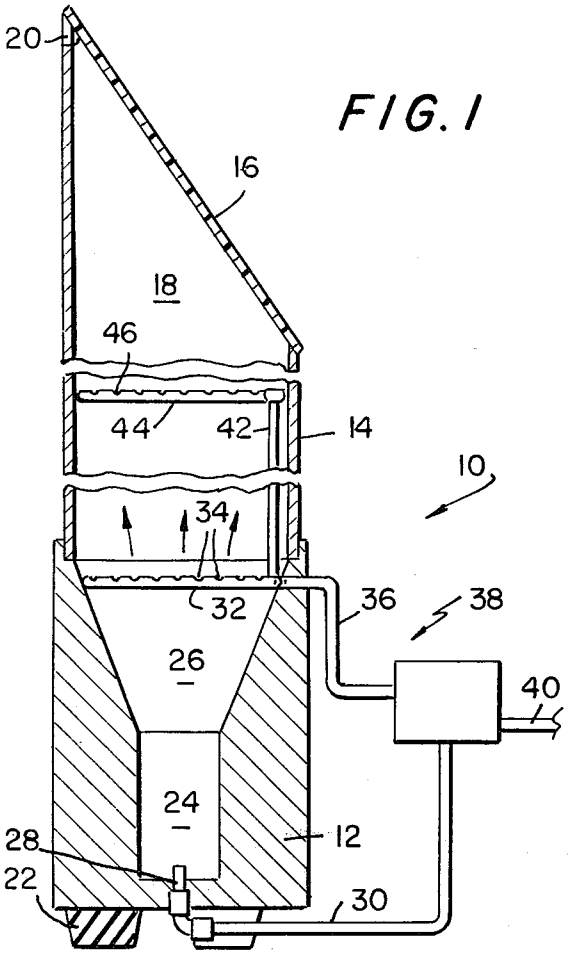
FIG. 1 is a cross-sectional plan view of the fiber disseminator of the present invention.

Referring now to FIG. 1, there is illustrated the fiber disseminator of the present invention, generally indicated as 10, and comprised of a generally cylindrically-shaped vertically disposed base member 12 on which is mounted a cylinder 14 having an upper end wall 16 formed of a transparent material disposed at an angle, such as 60° to the horizontal thereby forming a chamber 18. The cylinder 14 is formed with an opening 20 for ejecting single fibers together with the suspension gas.

The base member 12 is provided with support elements 22 and is formed with a lower cylindrically-shaped chamber 24 and an upper and outwardly extending conically-shaped chamber 26 with the chamber 26 forming a vertical connection with the cylinder 14.

The base member 12 is provided with an opening 28 centrally disposed within the chamber 24 to permit insertion of a conduit 30, as more fully hereinafter disclosed. The upper portion of the upper chamber 26 is provided with a circularly-shaped conduit 32 including orifices 34 and connected by a conduit 36 to a valve and air supply assembly, generally indicated as 38, in fluid communication with the compression side of a pump (not shown) via a conduit 40. Mounted above in spaced relationship to the circularly-shaped conduit 32 by a vertical conduit 42, there is disposed circularly-shaped conduit 44 including orifice 46, both conduits 32 and 44 being similarly dimensioned.

Figure 2:
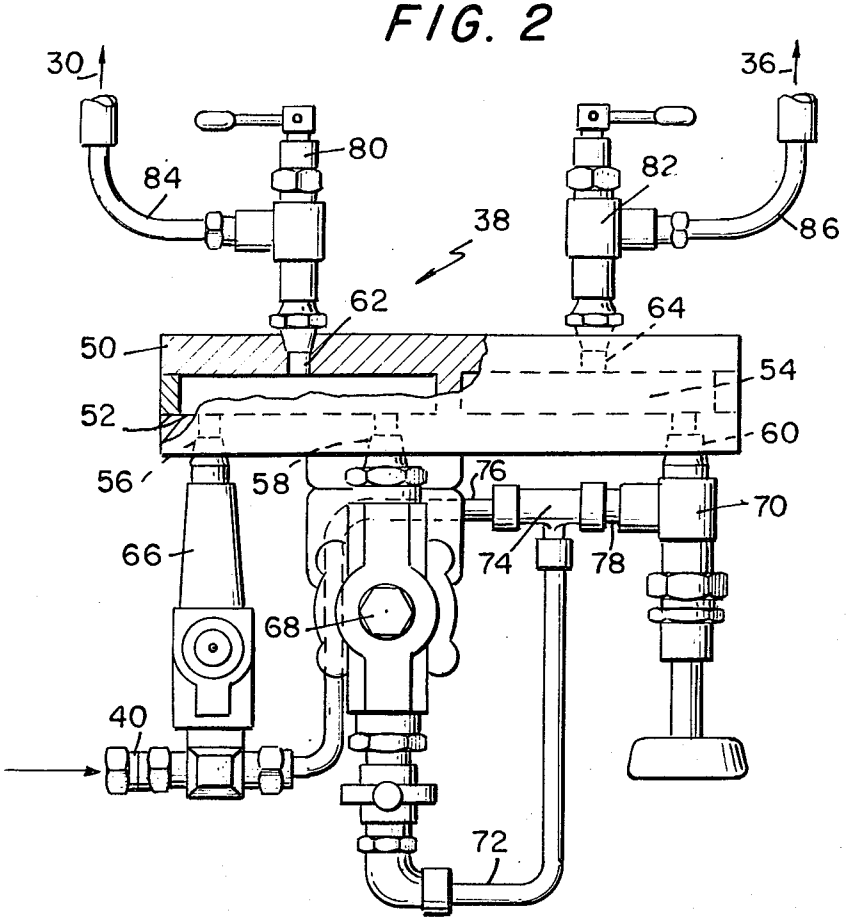
FIG. 2 is a plan view of the valving assembly therefor.

The valve and air supply assembly 38 referring now to FIG. 2, is comprised of a manifold member 50 including chambers 52 and 54 having openings 56 and 58, and opening 60. respectively, formed in one side of the manifold 50, and an opening 62 and an opening 64, respectively, formed in the other side of the manifold 50.

Disposed in fluid communication via the openings 56, 58 and 60, there are provided a manual valve 66, a solenoid valve 68 and a flow control valve 70, respectively. The solenoid valve 68 is in fluid communication via a conduit 72 with a T-fitting 74 which is in fluid communication by conduits 76 and 78 with manual valve 66 and flow control valve 70, respectively.

Disposed in fluid communication in the openings 62 and 64, there are provided flip valves 80 and 82, respectively, in fluid communication via conduits 84 and 86 with conduits 28 and 34, respectively.

In operation, the chamber 18, viewable or remote viewable depending on application, is provided with a predetermined quantity of amorphous fibers. A continuous stream of compressed air in line 40 is passed by the valve assembly 38 through the conduit 36 respectively into the circularly-shaped conduit 32 and via conduit 42 into the circularly-shaped conduit 44 whereby the particles or fibers are separated and dispersed by the flow of air through the orifices 34 and 46 of the conduits 32 and 44 through the chamber 18 in the disseminator 10 and ejected from the upper portion of the chamber 18 through the opening 20. Generally, an air flow of about 0.07 M/S effects the necessary separation and dispersion of fibers.

Intermittent streams of air at a pressure of from about 50 to about 150 psi are introduced by line 30 into the lower portion of the chamber 24 thereby to lift small clumps of particles or fibers from the lower portion of the chamber 24 and into the lower portion of chamber 18 whereat the fibers are gently agitated and separated with single fibers which rise in the upward gas current until ejected through the opening 20. Small clumps of particles or fibers which remain drift both downwardly into the lower chamber 24 to await another blast of air via line 30 to thereby suspend and disseminate the particles or fibers in the chamber 18.

The valve assembly 38 is comprised of the manifold 50 with the high pressure air supply 40 connected to the flow control valve 70 thence, through an isolated chamber 54 of the manifold 38 and out to the air supply line 36 via conduit 86 under the control of flip valve 82. Operation in such mode provides a continuous flow of air or other motive fluid (gas) to the disseminator 10 with the flip valves in the open position. A parallel flow through line 72 from the air supply line 40 is passed to the manual valve 66 and/or solenoid valve 68 thence, to the separate chamber 52 of manifold 36 and out through flip valve 80 to line 84 leading to connecting line 30 of the air supply line 30. Operation in this mode permits a manually controlled air supply, via spring loaded valve 66 or automatically timed and spaced intermittent blast of air to the disseminator through solenoid valve 68. The solenoid valve 68 is electrically powered through a timer (not shown).

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. A fiber disseminator which comprises:

a vertically-disposed vessel having lower, intermediate and upper chambers, said upper chamber being of larger cross-section than said lower chamber;

a top wall formed of a transparent material dispersed over said upper chamber of said vessel;

first conduit means for intermittently introducing a suspension media into a lower portion of said lower chamber, and for upwardly dispersing said fibers from a stored position in said lower chamber to a dispersed position in said intermediate and upper chambers;

second conduit means for continuously introducing said suspension media into said intermediate and upper chambers for separating and transporting said fibers through said upper chamber; and orifice means for ejection of separated fibers and venting of said suspension media from said upper chamber of said fiber disseminator, said orifice means including an opening positioned in a top end of said upper chamber;

said disseminator permitting dispersion of a known deposition of fiber of a controlled and selected size.

2. The fiber disseminator as defined in claim 1 wherein said top wall is disposed at an angle to an axis of said vessel.

3. The fiber disseminator as defined in claim 2 wherein said top wall is disposed at an acute angle with respect to a horizontal plane through said vertically-disposed vessel.

4. The fiber disseminator as defined in claim 1 wherein said second conduit means is disposed in said intermediate chamber.

5. The fiber disseminator as defined in claim 1 wherein said second conduit means is comprised of a circularly-shaped conduit having orifices formed therein for introducing air upwardly into said upper chamber.

6. The fiber disseminator as defined in claim 1 wherein said second conduit means is comprised of spaced-apart circularly-shaped conduits having orifices, said lower lower circularly-shaped conduit being disposed between said intermediate and upper chambers.

7. The fiber disseminator as defined in claim 6 wherein said intermediate chamber is in the shape of an inverted cone.

8. The fiber disseminator as defined in claim 7 wherein one of said circularly-shaped conduit means is disposed at said vertical section.

9. The fiber disseminator as defined in claim 1 wherein both said conduit means are in fluid communication with a source of compressed air via a common valve assembly which includes;

a manifold having a first chamber and a second chamber;

a first flip valve having an input side pneumatically connected to an outlet opening of said first chamber and an output connected to said first conduit means;

a second flip valve having an input side pneumatically connected to an outlet opening of said second chamber and an output connected to said second conduit means;

a manual valve having an output side pneumatically connected to a first inlet opening of said first chamber and an input side pneumatically connected to said source of compressed air;

a solenoid valve having an output side pneumatically connected to a second inlet opening of said first chamber and an input side pneumatically connected to said source of compressed air; and a flow control valve having an output side pneumatically connected to an inlet opening of said second chamber of said manifold and an outlet side connected to said source of compressed air.

* * * * *